US007004662B1

(12) United States Patent
Gordon

(10) Patent No.: US 7,004,662 B1
(45) Date of Patent: Feb. 28, 2006

(54) TOOTHBRUSH ASSEMBLY WITH TOOTHPASTE DISPENSER

(76) Inventor: C. David Gordon, 7905 Fischer's Way, Dexter, MI (US) 48130

( * ) Notice: Subject to any disclaimer, the term of this patent is extended or adjusted under 35 U.S.C. 154(b) by 132 days.

(21) Appl. No.: 10/798,113

(22) Filed: Mar. 11, 2004

Related U.S. Application Data

(63) Continuation-in-part of application No. 10/420,384, filed on Apr. 22, 2003, now Pat. No. 6,729,789.

(60) Provisional application No. 60/374,422, filed on Apr. 22, 2002.

(51) Int. Cl.
*A46B 11/04* (2006.01)
*B43K 5/06* (2006.01)

(52) U.S. Cl. ..... 401/278; 401/180

(58) Field of Classification Search ..... 401/178, 401/179, 180, 181, 182, 270, 278, 282
See application file for complete search history.

(56) References Cited

U.S. PATENT DOCUMENTS

| | | | | |
|---|---|---|---|---|
| 1,212,010 | A | | 1/1917 | Brown |
| 1,325,268 | A | | 12/1919 | Sosdian |
| 1,742,157 | A | | 12/1929 | Christian |
| 2,305,158 | A | | 12/1942 | Hanses |
| 2,652,949 | A | | 9/1953 | Martin |
| 3,337,893 | A | | 8/1967 | Fine et al. |
| 4,236,651 | A | * | 12/1980 | Meyer et al. ..... 222/82 |
| 5,039,244 | A | * | 8/1991 | Cheng ..... 401/176 |
| 5,480,038 | A | | 1/1996 | Collier |
| 5,810,856 | A | | 9/1998 | Tveras |
| 5,918,996 | A | | 7/1999 | Coolbaugh |
| 6,027,273 | A | | 2/2000 | Li |
| 6,056,469 | A | | 5/2000 | Algorri |
| 6,129,474 | A | | 10/2000 | Mitchell et al. |
| 6,206,600 | B1 | | 3/2001 | Rosenberg et al. |
| 6,213,662 | B1 | | 4/2001 | Aljanedi |
| 6,241,412 | B1 | | 6/2001 | Spies et al. |
| 6,257,791 | B1 | | 7/2001 | Scamard |
| 6,386,783 | B1 | | 5/2002 | Spielman |
| 6,390,103 | B1 | | 5/2002 | Manso |

* cited by examiner

*Primary Examiner*—David J. Walczak
(74) *Attorney, Agent, or Firm*—Butzel Long

(57) ABSTRACT

A toothbrush assembly includes a removable cartridge housing a spring biased piston dentifrice in a storage area. The cartridge is received in a canister attached to a brush head stem in which a passage is formed. The piston forces a quantity of the dentifrice through a supply tube in the cartridge to the passage that connects to an aperture in the brush head. A normally closed valve in the passage controls the flow of the dentifrice. The piston can be removed for refilling the cartridge with the dentifrice. Alternatively, the used cartridge may be replaced with a new prefilled disposable cartridge.

17 Claims, 4 Drawing Sheets

TOOTHBRUSH ASSEMBLY WITH TOOTHPASTE DISPENSER

CROSS-REFERENCE TO RELATED APPLICATIONS

This application is a continuation-in-part of the U.S. patent application Ser. No. 10/420,384 filed Apr. 22, 2003, now U.S. Pat. No. 6,729,789, which application claims the benefit of U.S. provisional patent application Ser. No. 60/374,422 filed Apr. 22, 2002.

BACKGROUND OF THE INVENTION

The present invention relates generally to a toothbrush apparatus and, in particular, to a toothpaste dispenser and toothbrush combination.

Toothbrushes and toothpaste dispensers are well known. Occasionally, the multiple steps of placing toothpaste from the toothpaste dispenser onto the brushes of the toothbrush become time-consuming and tedious. At other times, either the toothbrush, the toothpaste dispenser, or both, can not be located, causing frustration.

It is desirable, therefore, to provide a toothbrush having a toothpaste dispenser integral with the toothbrush body in order to overcome the disadvantages noted above. It is also desirable to provide a low cost toothbrush having a toothpaste dispenser that is reusable and/or includes replaceable components.

SUMMARY OF THE INVENTION

A toothbrush assembly in accordance with the present invention includes a canister releasably housing a cartridge for storing dentifrice (toothpaste) that is selectively provided to a brush head attached to a stem that is connected to the canister. A passage extends through the stem and connects an aperture in the brush head with a supply tube in an interior of the cartridge. A piston fits into an open upper end of the cartridge and is spring biased to force the dentifrice through the supply tube and the passage in the stem. A normally closed valve is disposed in the passage for controlling a flow of the dentifrice from the cartridge to the aperture in the brush head.

The toothbrush assembly in accordance with the present invention advantageously provides a toothbrush having a toothpaste dispenser integral with the toothbrush body. The toothbrush assembly in accordance with the present invention also provides a low cost toothbrush having a toothpaste dispenser that is reusable or replaceable.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 2 is a partial cross sectional view of an alternate embodiment toothbrush assembly according to the present invention.

DESCRIPTION OF THE PREFERRED EMBODIMENT

Figure 1:
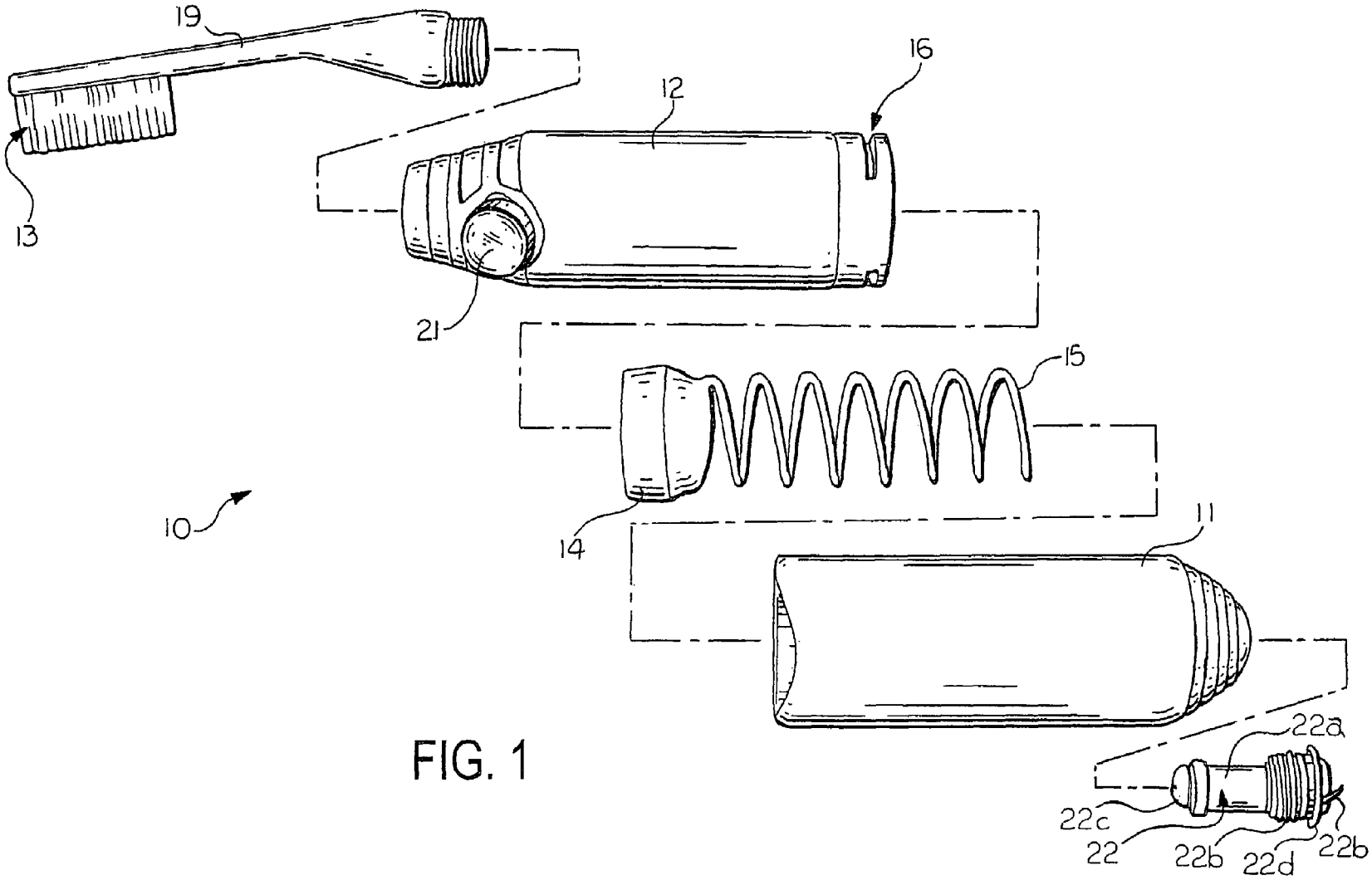
FIG. 1 is an exploded perspective view of a toothbrush assembly in accordance with the present invention.
Figure 2:
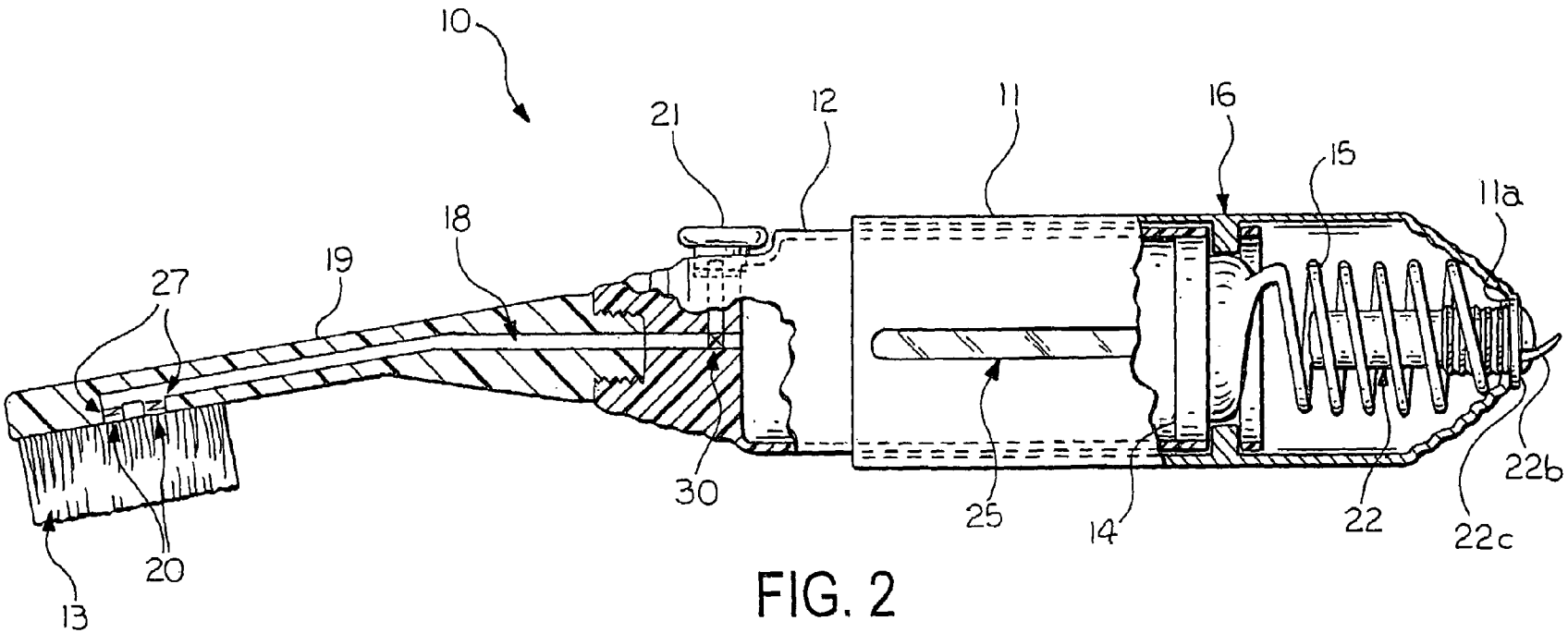
FIG. 2 is a partial cross sectional view of the toothbrush assembly in FIG. 1 shown in an assembled configuration.

Referring now to FIGS. 1 and 2, a toothbrush assembly according to the present invention is indicated generally at 10. The toothbrush assembly 10 includes a canister 11 for grasping by a human hand. An open upper end of the canister 11 is adapted to receive a dentifrice cartridge 12. Preferably, the cartridge 12 is substantially hollow with open upper and lower ends defining a dentifrice storage area therein. The open upper end of the cartridge 12 is releasably connected to a lower end of a brush head stem member 19. Preferably, the lower end of the brush head stem 19 is secured to the upper end of the cartridge 12 by a threaded connection or any suitable releasable attachment means. An upper end of the brush head stem 19 includes a brush head 13 attached thereto.

When the pre-filled cartridge 12 is inserted into the open upper end of the canister 11, the open lower end of the cartridge 12 receives a piston 14 that is slidably disposed in the interior of the canister 11. The piston 14 is biased by a compression spring 15 that is attached to a lower end of the piston 14 and engages at the interior of the lower end of the canister 11. The cartridge 12 is locked in place with the canister 11 by engaging a fitting 16 of the bayonet-type or similar fitting at the respective engaging bases of the canister 11 and the cartridge 12. In an alternative embodiment (not shown), the fitting 16 is in the form of a pair of downwardly extending tabs on the lower end of the cartridge 12 that cooperate with apertures formed near the lower end of the canister 11. The tabs clip into and can be released from the apertures through the application of finger pressure. Those skilled in the art, however, will appreciate that various means of releasably joining the cartridge 12 and the canister 11 may be utilized while remaining within the scope of the present invention.

When the cartridge 12 is filled with dentifrice and the upper end of the cartridge is blocked, as explained below, the piston 14 will be pushed downwardly compressing the spring 15 when the cartridge 12 is inserted in the canister 11. The spring 15 applies a force to the piston 14 which pressurizes the dentifrice in the cartridge 12. When the dentifrice in the cartridge 12 is exhausted, the cartridge 12 can be removed from the canister 11 by releasing the fitting 16 from the locked position. The removed cartridge 12 can be refilled and reinserted or another already filled cartridge 12 can be inserted.

A passage 18 is formed in the interior of the brush head stem 19 and at one end is exposed to the interior of the cartridge 12. At an opposite end of the passage 18 there is at least one aperture 20 in the brush head 13. Flow of the pressurized dentifrice is controlled by a valve, indicated schematically at 30, that is operable to be actuated by a button 21 located near the top of the cartridge 12. Alternatively, the button 21 is located at the base of the brush head stem 19 (not shown) or any other suitable location on the canister 11, the cartridge 12, or the brush head stem 19. When actuated, the valve 30 opens and allows the pressurized dentifrice to flow through the passage 18 from the cartridge 12 to the apertures 20. Preferably, the valve 30 and the button 21 include a means for returning the valve 30 to the closed position after the button 21 has been released. Preferably, a check valve, indicated schematically at 27, is installed in the passage 18 adjacent each of the apertures 20 to allow flow of the dentifrice out of the apertures 20 while preventing flow of the dentifrice or water into the apertures 20.

Alternatively, a functional dental floss unit 22 is attached to the base or lower end of the canister 11. Preferably, the dental floss unit 22 is attached to the canister 11 by a threaded connection or similar connection. As shown in FIGS. 1 and 2, the dental floss unit 22 includes a flanged spool 22*a* around which a string of dental floss 22*b* is wound. The spool 22*a* is rotatably mounted on a shaft 22*c* having a head 22*d* that threadably engages an aperture 11*a* formed in the end of the canister 11. Thus, the dental floss unit 22 can be removed from the canister 11 by unscrewing when the floss 22*b* is exhausted and either a replacement unit 22 can be installed or a new spool 22*a* with a supply of floss can be installed on the shaft 22*c*. As shown in FIGS. 1 and 2, the floss 22*b* can be dispensed through an opening in the head 22*d*.

Figure 3:
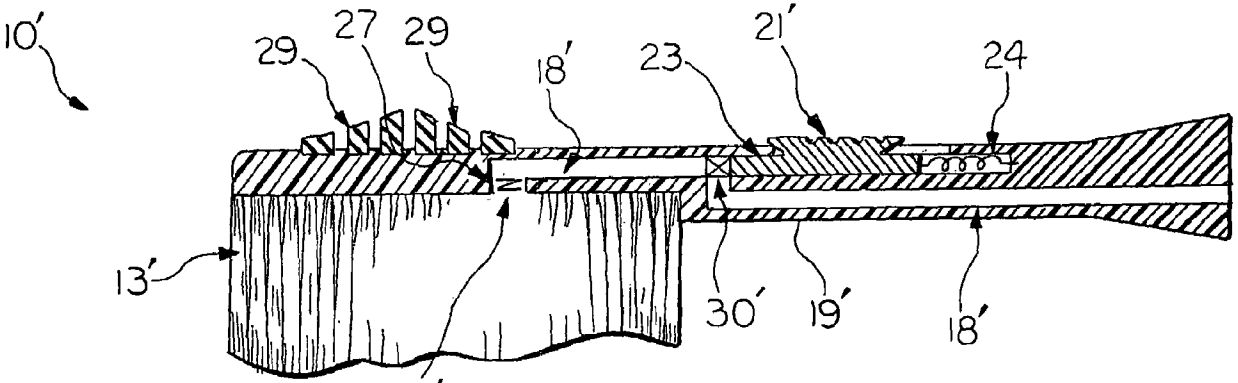
FIG. 3 is a fragmentary cross sectional view of an alternative embodiment of a brush head stem and brush head in accordance with the present invention.
Figure 4:
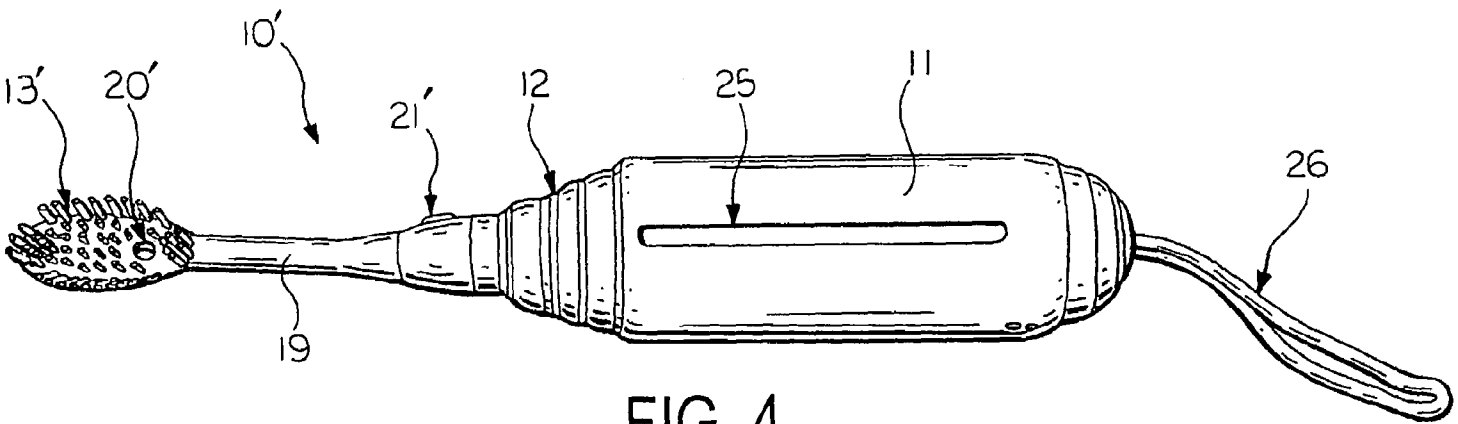
FIG. 4 is a perspective view of an alternative embodiment of a toothbrush assembly in accordance with the present invention; and FIG. 5

Referring now to FIGS. 3 and 4, an alternative embodiment of a toothbrush assembly according to the present invention is indicated generally at 10'. In the toothbrush assembly 10', a button 21' is located at the base of a stem 19'. The button 21' is operable to slidably actuate a valve 30' and includes a bolt piston 23 that is biased to a closed position by a spring 24. By placing pressure on the button 21' to slide the button 21' away from a brush head 13', the bolt piston 23 is moved to open the valve 30' allowing the pressurized dentifrice to be forced through a passage 18' and out of an aperture 20'. When pressure on the button 21' is released, the spring 24 returns the button 21', the bolt piston 23, and the valve 30' to the closed position, preventing any further flow through the passage 18'. Those skilled in the art, however, will realize that other types of valves or valve actuators can be utilized while remaining within the scope of the present invention.

A cord or lanyard 26, best seen in FIG. 4, can be attached to the bottom end of the canister 11 or to the dental floss unit 22. As shown in FIG. 3, a rear or dorsal surface of the brush head 13' can be provided with a plurality of upstanding flexible ribs 29 to be used as a tongue scraper.

As shown in FIGS. 2 and 4, a longitudinally extending window 25 can be provided in a wall of the canister 11 with the adjacent wall of the cartridge 12 being transparent or translucent or having a window for viewing the position of the piston 14 and to observe the quantity of the dentifrice remaining in the cartridge 12. Alternatively, the canister 11 can be made of a transparent material including, but not limited to, a clear plastic material or the like.

Figure 5:
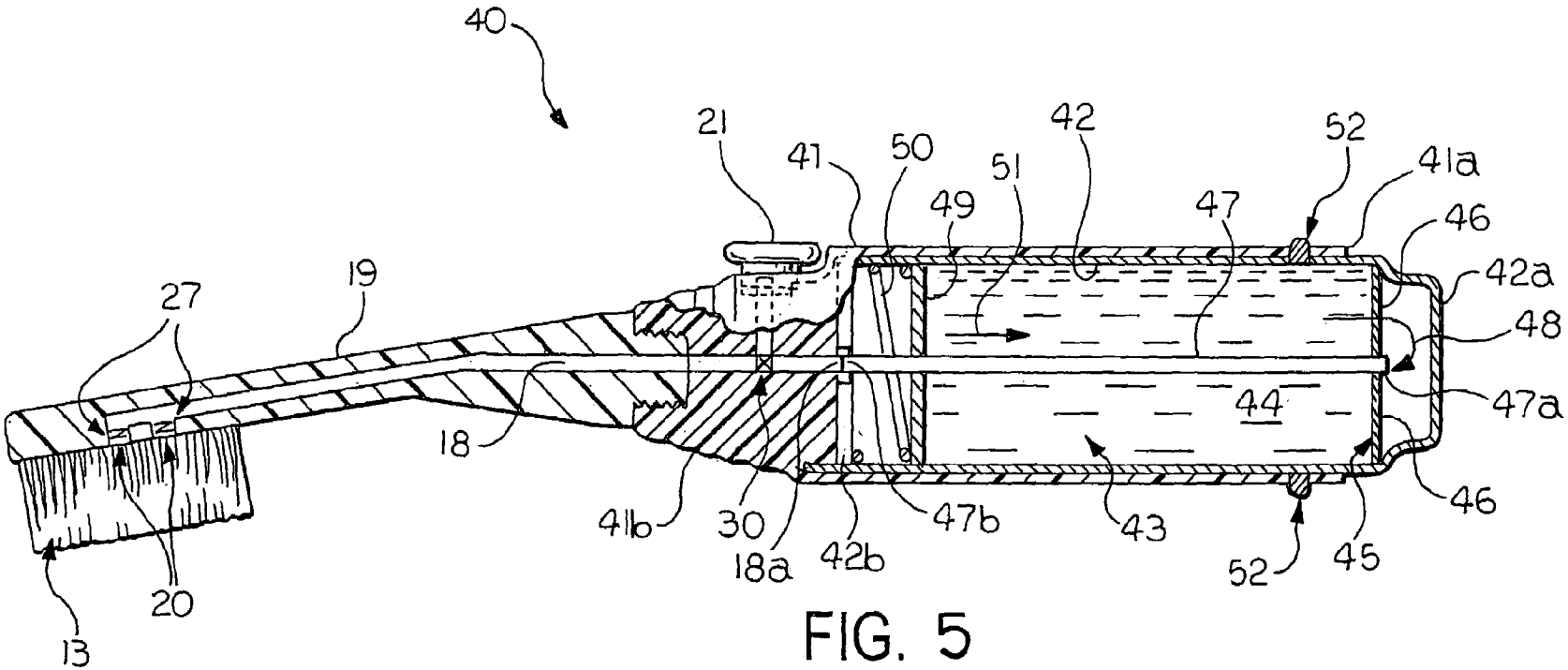

Referring now to FIG. 5, there is shown an alternate embodiment toothbrush assembly 40 according to the present invention. The toothbrush assembly 40 includes a canister 41 for grasping by a human hand. An open lower end 41*a* of the canister 41 is adapted to receive a dentifrice cartridge 42. Preferably, the cartridge 42 is substantially hollow with a closed lower end 42*a* and an open upper end 42*b* defining a dentifrice storage area 43 therein for receiving a quantity of dentifrice 44. An upper end 41*b* of the canister 41 is releasably connected to a lower end of the brush head stem member 19 that is shown in FIGS. 1 and 2. As in the embodiment shown in FIG. 1, the cartridge 42 may be locked in place with the canister 41 by engaging a fitting 52 of the bayonet-type or similar fitting. Preferably, the lower end of the brush head stem 19 is secured to the upper end 41*b* of the canister 41 by a threaded connection or any suitable releasable attachment means. The upper end of the brush head stem 19 includes the brush head 13 attached thereto.

A perforated wall 46 is positioned in the storage area 43 adjacent the lower end 42*a* of the cartridge 42. The wall 45 has a plurality of apertures 46 formed therein and is attached between an inner surface of the cartridge 42 and a lower end 47*a* of a supply tube 47. Thus, the dentifrice 44 in the storage area 43 above the wall 45 can flow through the apertures 46 and into the open lower end 47*a* of the supply tube 47 as indicated by an arrow 48. An open upper end 47*b* of the supply tube 47 mates with an open lower end 18*a* of the passage 18 extending through the brush head stem 19 and continuing through the upper end 41*b* of the canister 41. A disk-shaped piston 49 is slidably mounted in the storage area 43 to contain the dentifrice 44. The cartridge 42 can be disposable (one use) or reusable. If the cartridge 42 is to be refilled with the dentifrice 44, the piston 49 can be removed from the storage area 43 at the open upper end 42*b* and replaced after the dentifrice has been loaded. The supply tube 47 extends through a central aperture in the piston 49 and a periphery of the piston slidably engages the interior surface of the cartridge 42.

An actuator 50, preferably a helical compression spring, is positioned in the upper end 42*b* of the cartridge 42 to act between an upper surface of the piston 49 and a facing surface of the hollow interior at the upper end 41*b* of the canister 41. The actuator 50 forces the piston 49 in a direction of an arrow 51 toward the wall 45 thereby causing the dentifrice 44 to flow in the direction of the arrow 48 when the valve 30 is actuated to supply the dentifrice to the brush 13 through the passage 18.

The cartridge 42 is releasably locked in the canister 41 by engaging a fitting 52 of the bayonet-type or similar having pins on the cartridge engaging slots formed in the wall of the canister 41. Also, the head of the stem 19 can be provided with the ribs 29 shown in FIG. 3, and the cartridge 42 can be provided with the dental floss unit 22 shown in FIG. 1 and/or the lanyard 26 shown in FIG. 4.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A toothbrush assembly comprising:

a hollow cartridge having an open upper end, a closed lower end, an internal storage area for receiving a quantity of dentifrice, and a piston slidably mounted in said storage area;

a canister having an open lower end and a hollow interior receiving said cartridge;

a brush head stem having a brush head and being attached to said canister, a passage extending through said stem connecting at least one aperture formed in said brush head with said storage area;

a normally closed valve cooperating with said passage for controlling a flow of dentifrice from said storage area to said at least one aperture in said brush head; and an actuator positioned in said open upper end of said cartridge and applying a force to said piston whereby when dentifrice is present in said storage area and said valve is opened, said actuator moves said piston to force a quantity of the dentifrice to flow from said storage area and through said passage to said at least one aperture in said brush head.

2. The toothbrush assembly according to claim 1 wherein said valve is operable to be controlled by a button located on said canister.

3. The toothbrush assembly according to claim 1 wherein said cartridge is attached to said canister by a bayonet-type fitting.

4. The toothbrush assembly according to claim 1 including a supply tube positioned in said cartridge and connecting said storage area with said passage.

5. The toothbrush assembly according to claim 4 including a perforated wall positioned in said storage area adjacent said closed lower end of said cartridge, said wall being attached to an interior surface of said cartridge and to a lower end of said supply tube.

6. The toothbrush assembly according to claim 4 wherein said piston includes an aperture receiving said supply tube.

7. The toothbrush assembly according to claim 1 wherein said actuator is a helical compression spring.

8. A toothbrush assembly comprising:

a hollow cartridge having an open upper end, a closed lower end, an internal storage area for receiving a quantity of dentifrice and a perforated wall mounted in said storage area and attached to an interior surface of said cartridge;

a supply tube positioned in said storage area and attached to said perforated wall;

a piston positioned in said storage area and slidably mounted on said supply tube;

a canister having an open lower end and a hollow interior receiving said cartridge;

a brush head stem having a brush head and being attached to said canister, a passage extending through said stem connecting at least one aperture formed in said brush head with said supply tube;

a normally closed valve cooperating with said passage for controlling a flow of dentifrice from said storage area to said at least one aperture in said brush head; and a spring positioned in said open upper end of said cartridge and applying a force to said piston whereby when dentifrice is present in said storage area and said valve is opened, said spring moves said piston to force a quantity of the dentifrice to flow through said supply tube and said passage to said at least one aperture in said brush head.

9. The toothbrush assembly according to claim 8 wherein said valve is operable to be controlled by a button located on said canister.

10. The toothbrush assembly according to claim 8 wherein said cartridge is attached to said canister by a bayonet-type fitting.

11. The toothbrush assembly according to claim 8 wherein said piston includes an aperture receiving said supply tube.

12. The toothbrush assembly according to claim 8 wherein said spring is a helical compression spring.

13. The toothbrush assembly according to claim 8 wherein at least another aperture is formed in said brush head.

14. A dentifrice supply apparatus for a toothbrush assembly, the toothbrush assembly having a brush head stem with a passage formed therein for supplying dentifrice to an aperture in a brush head of the stem, comprising:

a hollow cartridge having an open upper end, a closed lower end and an internal storage area;

a supply tube positioned in said storage area and adapted to be connected the passage of the brush head stem;

a piston slidably mounted on said supply tube; and a quantity of dentifrice retained in said storage area between said piston and said lower end of said cartridge whereby when the dentifrice supply apparatus is attached to the toothbrush assembly and said piston is moved toward said lower end, a quantity of said dentifrice is caused to flow from said storage area and through said supply tube to the passage.

15. The toothbrush assembly according to claim 14 including a bayonet-type fitting attached to said cartridge and adapted to connect said cartridge to the toothbrush assembly.

16. The toothbrush assembly according to claim 15 including a perforated wall positioned in said storage area adjacent said closed lower end of said cartridge, said wall being attached to an interior surface of said cartridge and to a lower end of said supply tube.

17. The toothbrush assembly according to claim 14 wherein said piston includes an aperture receiving said supply tube.

* * * * *